US006398626B1

(12) United States Patent
Matsuo et al.

(10) Patent No.: US 6,398,626 B1
(45) Date of Patent: Jun. 4, 2002

(54) POLISHING APPARATUS

(75) Inventors: Hisanori Matsuo, Fujisawa; Hirokuni Hiyama, Tokyo; Yutaka Wada, Chigasaki; Kazuto Hirokawa, Chigasaki; Tetsuji Togawa, Chigasaki, all of (JP)

(73) Assignee: Ebara Corporation, Tokyo (JP)

( * ) Notice: Subject to any disclaimer, the term of this patent is extended or adjusted under 35 U.S.C. 154(b) by 10 days.

(21) Appl. No.: 09/612,216

(22) Filed: Jul. 7, 2000

(30) Foreign Application Priority Data

Jul. 7, 1999 (JP) ..... 11-193299

(51) Int. Cl.[7] ..... B24B 1/00

(52) U.S. Cl. ..... 451/66; 451/5; 451/41; 451/56; 451/60; 451/287; 451/443

(58) Field of Search ..... 451/5, 41, 56, 451/60, 287, 288, 289, 443

(56) References Cited

U.S. PATENT DOCUMENTS 5,329,732 A 7/1994 Karlsrud et al.
5,738,574 A 4/1998 Tolles et al.
5,804,507 A * 9/1998 Perlov et al. ..... 438/692
5,902,173 A 5/1999 Tanaka
5,957,751 A * 9/1999 Govzman et al. ..... 451/8

FOREIGN PATENT DOCUMENTS

EP 0 928 662 A2 8/1998
JP 11-204468 7/1999

* cited by examiner

*Primary Examiner*—Joseph J. Hail, III
*Assistant Examiner*—Shantese McDonald
(74) *Attorney, Agent, or Firm*—Wenderoth, Lind & Ponack, L.L.P.

(57) ABSTRACT

A polishing apparatus is used for polishing a plate-like workpiece, such as a semiconductor wafer or a glass substrate. The polishing apparatus has a polishing table having a polishing surface thereon, a plurality of workpiece holders each for holding a workpiece and pressing the workpiece against the polishing surface, and a dresser for dressing the polishing surface by pressing a desired position of the polishing surface.

25 Claims, 13 Drawing Sheets

POLISHING APPARATUS

BACKGROUND OF THE INVENTION

1. Field of the Invention

The present invention relates to a polishing apparatus for polishing a plate-like workpiece such as a semiconductor wafer or a glass substrate.

2. Description of the related art

Recent rapid progress in semiconductor device integration demands smaller and smaller wiring patterns or interconnections and also narrower spaces between interconnections which connect active areas. One of the processes available for forming such interconnection is photolithography. Although the photolithographic process can form interconnections that are at most 0.5 $\mu$m wide, it requires that surfaces of semiconductor wafers on which pattern images are to be focused by a stepper be as flat as possible because the depth of focus of the optical system is relatively small. It is, therefore, necessary to planarize the surfaces of the semiconductor wafers for photolithography. One customary way of planarizing the surfaces of the semiconductor wafers is to polish them with a polishing apparatus.

FIG. 13 of the accompanying drawings shows a main part of a conventional polishing apparatus. The polishing apparatus comprises a rotating polishing table 100 with a polishing cloth 102 made of urethane or the like attached to an upper surface of the polishing table 100, a top ring (workpiece holder) 104 for holding a semiconductor wafer W which is a workpiece to be polished and pressing the semiconductor wafer W against the polishing table 100 while the top ring 104 is rotated, and a polishing liquid supply nozzle 106 for supplying a polishing liquid Q to the polishing cloth 102. The top ring 104 is connected to a top ring shaft 110 through a spherical bearing 108 so that the top ring 104 is tiltable with respect to the top ring shaft 110. The top ring 104 is provided with an elastic pad 112 made of polyurethane or the like on its lower surface, and the semiconductor W is held by the top ring 104 in contact with the elastic pad 112. The top ring 104 also has a cylindrical guide ring 114 mounted on a lower outer circumferential edge thereof for retaining the semiconductor wafer W on the lower surface of the top ring 104.

In operation, the semiconductor wafer W is held against the lower surface of the elastic pad 112, and pressed against the polishing cloth 102 on the polishing table 100 by the top ring 104. The polishing table 100 and the top ring 104 are rotated to move the polishing cloth 102 and the semiconductor wafer W relative to each other. At this time, the polishing liquid Q is supplied onto the polishing cloth 102 from the polishing liquid supply nozzle 106. The polishing liquid Q comprises a chemical solution such as an alkali solution containing abrasive particles suspended therein. The semiconductor wafer W is polished by a composite action comprising a chemical polishing action of the chemical solution and a mechanical polishing action of the abrasive particles. This polishing is called chemical mechanical polishing.

In the chemical mechanical polishing (CMP) apparatus using the polishing cloth 102, since the polishing cloth 102 is made of material having elasticity, irregularities of a polished surface of the semiconductor wafer remain, and the surface of the semiconductor wafer cannot be sufficiently planarized. Therefore, the conventional CMP apparatus cannot cope with a demand for a higher degree of planarization of the semiconductor wafer.

To be more specific, a device pattern on the upper surface of the semiconductor wafer W has various irregularities having various dimensions and steps. When the semiconductor wafer W having step-like irregularities is planarized by the polishing cloth 102 having elasticity, not only raised regions but also depressed regions are formed. Hence, irregularities of the polished surface of the semiconductor wafer are difficult to eliminate, with the result that a high degree of flatness of the polished surface cannot be obtained.

Further, the surface of the polishing cloth 102 tends to have irregularities, and hence, it is necessary to frequently perform dressing of the surface of the polishing cloth 102 to remove glazing of the surface of the polishing cloth 102.

Furthermore, a considerable proportion of the polishing liquid Q supplied to the polishing cloth 102 is discharged without reaching the surface of the semiconductor wafer to be polished. Consequently, the polishing liquid Q is required to be supplied in a large quantity, and hence, an operating cost in the polishing process becomes high because the polishing liquid is expensive and the cost of a process for treating the polishing liquid is high.

Therefore, there has been developed a fixed abrasive type of polishing apparatus and method in which a polishing surface comprising an abrading plate, i.e., a fixed abrasive plate is used, in place of the polishing cloth 102. The abrading plate comprises abrasive particles such as silica particles and a binder for binding the abrasive particles, and is formed into a flat plate. FIG. 14 shows a main part of a conventional polishing apparatus having such abrading plate. The polishing apparatus comprises a polishing table 100 with a polishing tool 120 attached to an upper surface thereof, and liquid supply nozzles 124 connected to a liquid supply device 122 for supplying water or a chemical liquids during polishing. The polishing tool 120, attached to the upper surface of the polishing table 100, comprises a base plate 116 and an abrading plate 118 attached to the surface of the base plate 116. Other structures of the polishing apparatus shown in FIG. 14 are the same as that of the conventional polishing apparatus shown in FIG. 13.

According to the above polishing process, the abrading plate (fixed abrasive) is harder than the polishing cloth and has less elastic deformation than the polishing cloth. Hence, only the raised regions on the semiconductor wafer are polished and undulation of the polished surface of the semiconductor wafer is prevented from being formed. Therefore, selective polishing performance of the raised regions on the semiconductor wafer is improved, a degree of flatness of the semiconductor wafer is improved, and an expensive polishing liquid Q is not required to be used.

Further, it is confirmed by the inventors of the present application that in the polishing method using the fixed abrasive, the polished surface of the semiconductor wafer is planarized once to a certain level, and then the polishing rate is lowered extremely to show a self-stop ability of polishing because of nature of the fixed abrasive. Therefore, the inventors of the present application have proposed to utilize such self-stop ability of polishing for detecting an endpoint of polishing or detecting a thickness of a film formed on the semiconductor wafer W in Japanese Patent Application Nos. 10-150546 and 10-134432.

Recently, there have been strong demands in the polishing apparatus for polishing semiconductor wafers field for an improvement of productivity per apparatus and improvement of productivity per unit installation area of the apparatus, as in other semiconductor manufacturing apparatuses. However, in the polishing apparatus having a single top ring per polishing table, the polishing surface on the polishing table is not effectively utilized, and therefore, the productivity per unit installation area of the apparatus cannot be improved.

In order to solve the above problem, it is conceivable that a plurality of top rings are provided with respect to a single polishing table for thereby utilizing a polishing surface on the polishing table efficiently. However, in this case, the polishing surface on the polishing table is rapidly deteriorated and the polishing rate is lowered, and frequently conducted dressing operations lower an operating efficiency of the polishing apparatus. Particularly, in a case of the fixed abrasive method, it is necessary to dress the polishing surface on the polishing table frequently to regenerate and planarize the polishing surface because the polishing surface is worn away by the polishing operation and irregularities of the polishing surface are formed.

Further, in a case of conducting finish polishing of the semiconductor wafer, in order to avoid formation of fine scratches on the polished surface of the semiconductor wafer, it is necessary to use a fixed abrasive having different compositions or a different polishing table having a polishing cloth thereon. Hence, throughput of the semiconductor wafers is greatly lowered.

SUMMARY OF THE INVENTION

It is therefore an object of the present invention to provide a polishing apparatus which has a high processing capability per unit time and unit installation area in a clean room requiring an expensive operating cost.

According to an aspect of the present invention, there is provided a polishing apparatus for polishing a surface of a workpiece. The polishing apparatus comprises a polishing table having a polishing surface thereon, a plurality of workpiece holders each for holding a workpiece and pressing the workpiece against the polishing surface, and a dresser for dressing the polishing surface by pressing a desired position of the polishing surface.

According to the present invention, when workpieces, such as semiconductor wafers, are polished by utilizing a polishing surface efficiently, even if a deteriorating rate of the polishing surface is high, the workpieces can be efficiently polished to a high degree of flatness while forming a good polishing surface at all times and regenerating the polishing surface by dressing.

In a preferred aspect of the present invention, the polishing surface has a plurality of polishing positions which have different dressing effects.

In the case where the polishing table is a rotating-type polishing table, the polishing surface has the most efficient polishing performance at a polishing position immediately downstream of the dressing position, in a rotational direction of the polishing table, where dressing of the polishing surface is performed. The polishing surface has less efficient polishing performance at other polishing positions where deterioration of the polishing surface progresses because at least one of the workpieces has been polished once. By utilizing these characteristics, the workpieces can be polished under different polishing conditions at different polishing positions.

In a preferred aspect of the present invention, the workpiece is sequentially polished by moving the workpiece to the plurality of polishing positions sequentially.

In a preferred aspect of the present invention, an initial polishing of the workpiece is conducted at the polishing position where the dressing effect remains large, and a secondary polishing or a finish polish of the workpiece is conducted at the polishing position where the dressing effect remains small.

In a preferred aspect of the present invention, the polishing pressure applied to the workpiece by the workpiece holder is controlled on the basis of the dressing effect remaining on the polishing surface. If the dressing effect remains large at a certain polishing position, the polishing pressure applied to the workpiece and/or the relative sliding speed between the workpiece and the polishing surface are decreased. Conversely, if the dressing effect remains small at a certain polishing position, the polishing pressure applied to the workpiece and/or the relative sliding speed between the workpiece and the polishing surface are increased.

In a preferred aspect of the present invention, the polishing surface has a plurality of polishing positions, and dressing effects on the plurality of polishing positions by the dresser are equal to one another.

With this arrangement, a plurality of polishing positions on the polishing surface where a plurality of workpiece holders are located can be kept at a constant polishing performance having a certain level. Hence, a plurality of workpieces can be polished under the same polishing condition.

In a preferred aspect of the present invention, a plurality of dressers are provided so as to correspond to the plurality of workpiece holders.

In a preferred aspect of the present invention, the dresser is provided so as to dress an entire surface of the polishing surface.

A dressing load applied to the polishing surface by the dresser or the relative speed between the dresser and the polishing surface may be controlled depending on the number of workpieces which are polished simultaneously. For example, if the number of workpieces is large, the dressing load is increased, and if the number of workpieces is small, the dressing load is decreased. Thus, the dressing load is controlled according to the degree of deterioration caused by polishing operation.

In a preferred aspect of the present invention, the polishing surface comprises a polishing cloth, or a fixed abrasive plate having a self-generation function of abrasive particles.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 4A is a plan view and FIG. 4B is a front view;

FIG. 9A is a front view and FIG. 9B is a plan view;

FIG. 10A is a plan view and FIG. 10B is a front view;

FIG. 11A is a plan view and FIG. 11B is a front view;

DETAILED DESCRIPTION OF THE INVENTION

Next, a polishing apparatus according to the present invention will be described below with reference to the drawings.

Figure 1:
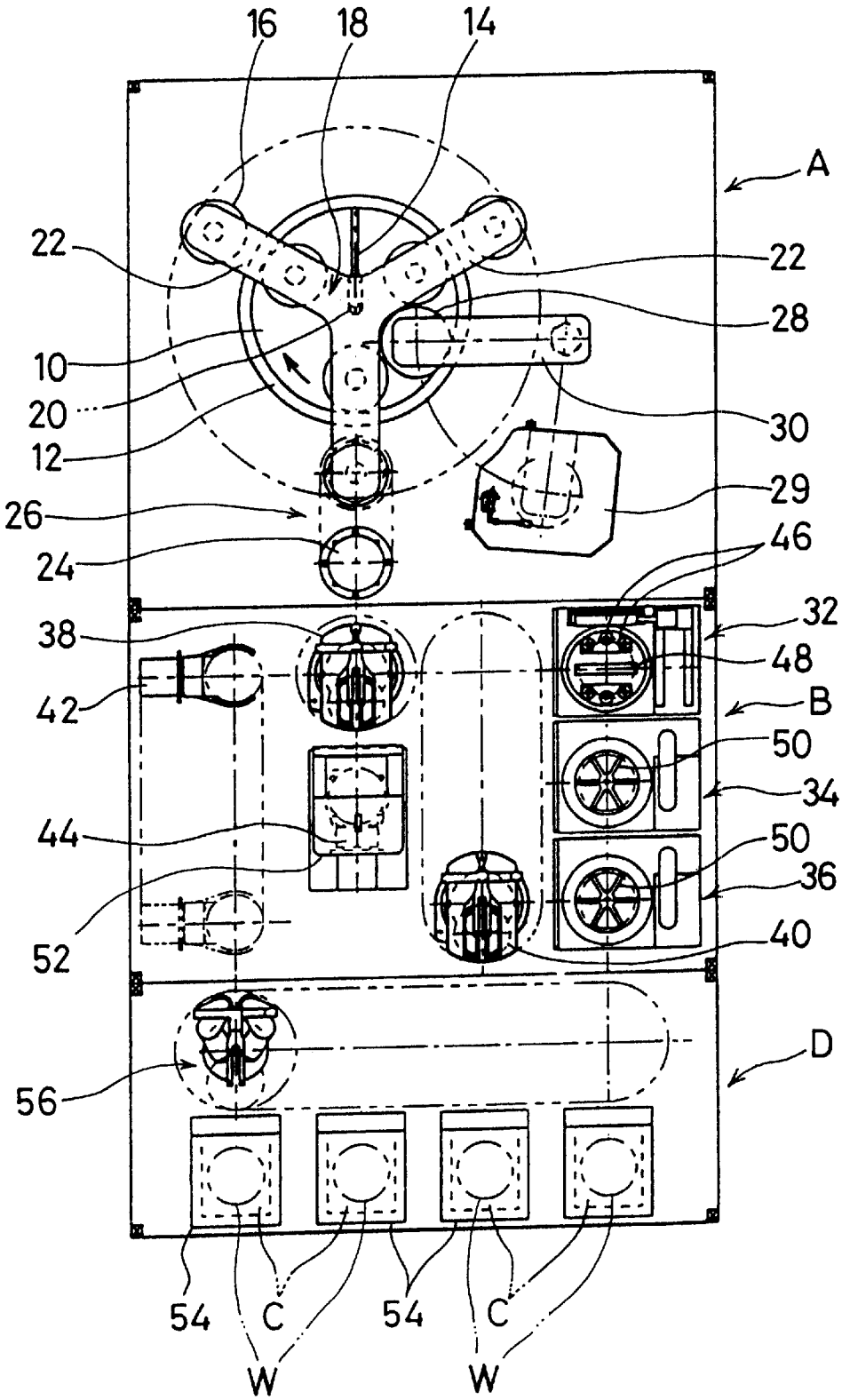
FIG.1 is a plan view showing a whole structure of a polishing apparatus according to a first embodiment of the present invention.

FIG. 1 shows a polishing apparatus according to a first embodiment of the present invention. As shown in FIG. 1, the polishing apparatus has a polishing section A for polishing semiconductor wafers W, a cleaning section B disposed in front of the polishing section A for cleaning and drying polished semiconductor wafers W, and a loading/unloading section D disposed in front of the cleaning section B and having wafer cassettes C for housing semiconductor wafers W that are to be polished and have been polished. Each of the polishing section A, the cleaning section B, and the loading/unloading section D is accommodated in a housing.

Figure 13:
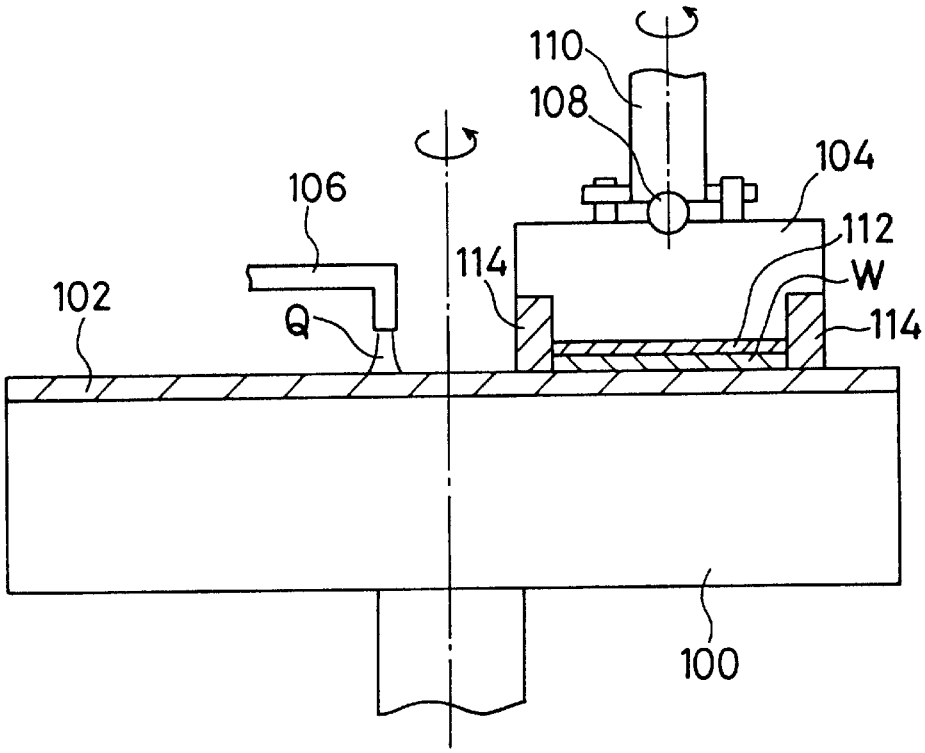
FIG. 13 is a cross-sectional view of a conventional polishing apparatus according to an example.
Figure 14:
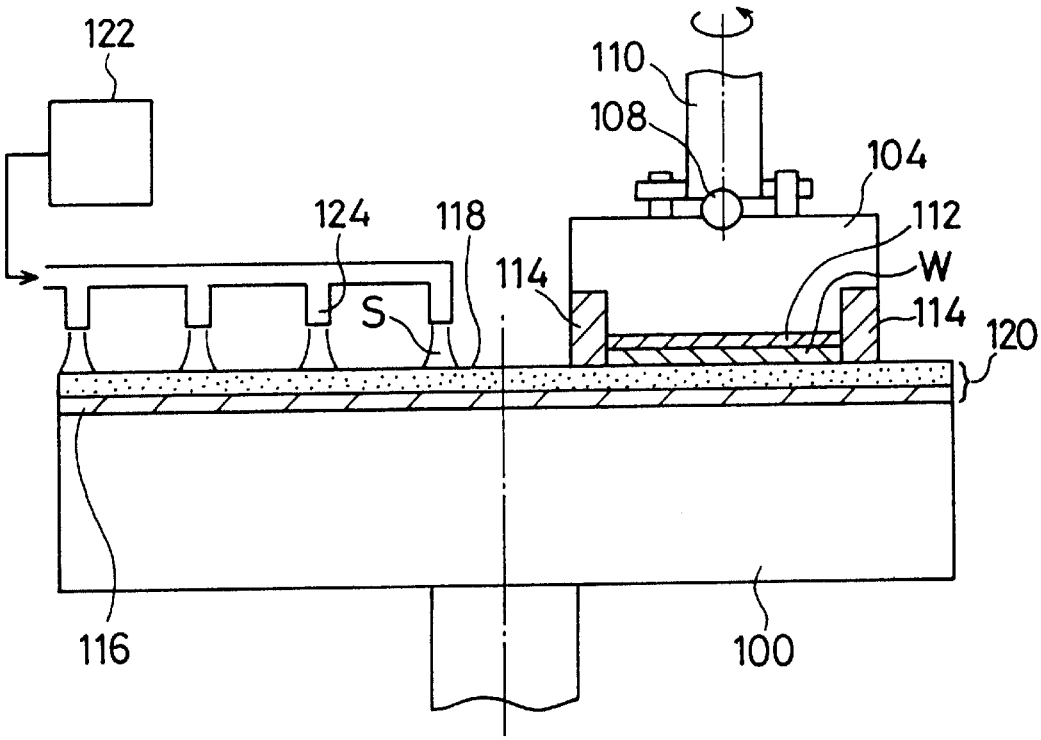
FIG. 14 is a cross-sectional view of a conventional polishing apparatus according to another example.

In the polishing section A, a polishing table 12 having a polishing surface 10 is provided. The polishing surface 10 comprises a polishing cloth 102 (see FIG. 13) attached to the upper surface of the polishing table 12 or an abrading plate 118 (see FIG. 14) attached to the upper surface of the polishing table 12. In this embodiment, the polishing table 12 comprises a rotation-type polishing table which is rotatable about its own central axis. However, the polishing table 12 may comprise a scroll-type table which makes a circulative translational motion (scroll motion) along a circle having a small radius without rotating about its own axis. The polishing table may include both of the rotation-type polishing table and the scroll-type table, and it may be possible to select one of them in accordance with the essence of the present invention.

The polishing section A also has a liquid supply nozzle 14 disposed above the polishing table 12 and supported by a nozzle arm for supplying a polishing liquid or water to the polishing surface 10. Further, the polishing section A has three top rings (workpiece holders) 16 supported by a top ring support assembly 18 for holding semiconductor wafers W and keeping surfaces of the semiconductor wafers W to be polished in contact with the polishing surface 10 on the polishing table 12 for thereby, polishing the semiconductor wafers W.

The top ring support assembly 18 is rotatably and vertically movably supported on a support column 20 which is disposed at a central position of the polishing surface 10. The top ring support assembly 18 has three radial support arms 22, each supporting one of the top rings 16, a motor for rotating the top ring 16, and an air cylinder for vertically moving the top ring 16 and pressing the top ring 16 against the polishing table 12. The air cylinders are capable of vertically moving the top rings 16 independently of each other, and also of adjusting their pressing pressures independently of each other.

The polishing section A also has a rotary transporter 26 having two pushers 24 for attaching a semiconductor wafer W to and removing a semiconductor wafer W from a top ring 16. The rotary transporter 26 is rotatably supported by a support post at an intermediate position between the two pushers 24. When the support post rotates about its own axis, either one of the two pushers 24 can move selectively to a transfer position near the polishing table 12 and a transfer position near the cleaning section B.

Each of the top rings 16 or the support arm 22 has a moving mechanism for moving the top ring 16 along the support arm 22 radially across the polishing table 12. When the top ring 16 is thus moved, it can move selectively to a position above the polishing surface 10 and a position above the pusher 24 which is located in the transfer position near the polishing table 12. In FIG. 1, both of the positions for the top ring 16 are illustrated.

The polishing section A further includes a dresser 28 for dressing the polishing surface 10 on the polishing table 12. The dresser 28 is mounted on one end of a dresser arm 30. When the dresser arm 30 is swung about a shaft on the other end thereof, the dresser 28 can move between a dressing position on the polishing surface 10 and a standby position outside of the polishing table 12. A cleaning container 29, which stores a cleaning liquid for cleaning the dresser 28, is disposed in the standby position of the dresser 28.

The cleaning section B has three cleaning units 32, 34 and 36, two feed robots 38, 40, and two reversing machines 42, 44. The cleaning unit 32 has rollers 46 for holding the circumferential edge of a semiconductor wafer W and rotating the semiconductor wafer W at a relatively low speed, and sponge rolls 48 for cleaning both surfaces of the semiconductor wafer W while the semiconductor wafer W is rotating at the relatively low speed. The cleaning unit 34 has a holder 50 for holding a semiconductor wafer W and rotating the semiconductor wafer W at a relatively high speed, and applies a jet of cleaning liquid to both surfaces or a polished surface of the semiconductor wafer W to clean the semiconductor wafer W while the holder 50 is rotating at the relatively high speed. The cleaning unit 36 has a holder 50 for holding a semiconductor wafer W and rotating the semiconductor wafer W at a relatively high speed or a high speed, and cleans a polished surface of the semiconductor wafer W with a pencil-shaped sponge member while the holder 50 is rotating at tie relatively high speed, after which the semiconductor wafer W is rotated at the high speed to dry the semiconductor wafer W by way of a spin dry process.

The two feed robots 38, 40 serve to feed semiconductor wafers W. Each of the feed robots 38, 40 hag a hand for holding a dry semiconductor wafer W and a hand for holding a wet semiconductor wafer W. If a robot (first robot) 56 in the loading/unloading section D is used to remove a semiconductor wafer W from the cleaning unit in the final stage, then the robot 40 may only have a hand for holding a wet semiconductor wafer W. The robot (second robot) 38 is not a mobile robot, but is fixed in a position near the rotary transporter 26. The robot 38 is rotatable to change its direction for transferring a semiconductor wafer W. The robot (third robot) 40 is a mobile robot movable along the array of cleaning units 32, 34 and 36.

Of the two reversing machines 42, 44, the reversing machine 42 serves to reverse a dry semiconductor wafer W and is movable between an end of the cleaning section B near the polishing section A and an opposite end of the cleaning section B near the loading/unloading section D. The second reversing machine 44 serves to reverse a wet semiconductor wafer W, and is housed in a cover 52.

The loading/unloading section D has an array of cassette bases 54 for placing thereon wafer cassettes C which house semiconductor wafers W or which are to house semiconductor wafers W, and a single robot (first robot) 56 for feeding a semiconductor wafer W. The robot 56 has a single hand for holding a dry semiconductor wafer W.

The polishing section A, the cleaning section B, and the loading/unloading section D are individually partitioned by walls so as to form respective chambers. The internal pressures of the chambers are controlled such that air in a chamber having a relatively low level of cleanliness does not leak into a chamber having a relatively high level of cleanliness. The walls have wafer passages defined therein. Each of the wafer passages has a vertically movable shutter, which is opened only when a semiconductor wafer W is to pass therethrough. When air is discharged from the polishing apparatus, the air is passed through a HEPA or ULPA filter so as to prevent the environment of a clean room in which the polishing apparatus is installed, from being contaminated by the discharged air.

Operation of the polishing apparatus shown in FIG. 1 will be described below. First, operation of the polishing section A will be described below. Since the polishing section A has the single rotary transporter 26 for replacing semiconductor wafers W on the plural top rings 16, it is most efficient to polish semiconductor wafers W on three top rings 16 out of phase with each other. Depending on the material of the semiconductor wafers W and the polishing process, however, it may be possible to select an operation control program to polish all semiconductor wafers W simultaneously in a batch process after the semiconductor wafers W have been mounted on all the top rings 16.

The former standard polishing process will be described below. A wafer cassette C which houses semiconductor wafers to be polished is automatically or manually supplied from the outside of the polishing apparatus to the loading/unloading section D, and placed on one of the cassette bases 54 in the loading/unloading section D.

The first robot 56 in the loading/unloading section D removes a semiconductor wafer W from the supplied wafer cassette C, and transfers the removed semiconductor wafer W to the reversing machine (first reversing machine) 42 in the cleaning section B. The first reversing machine 42 which has received the semiconductor wafer W reverses the semiconductor wafer W such that its surface to be polished faces downward, and then moves to a position confronting the second robot 38.

The second robot 38 rotates so as to face the first reversing machine 42, and receives the semiconductor wafer W from the first reversing machine 42 with the hand which serves to hold a dry semiconductor wafer. Then, the second robot 38 rotates so as to face the rotary transporter 26 in the polishing section A, and transfers the semiconductor wafer W to the pusher 24 of the rotary transporter 26 which is positioned closer to the cleaning section B, i.e., the pusher 24 closer to the second robot 38.

Figure 2A:
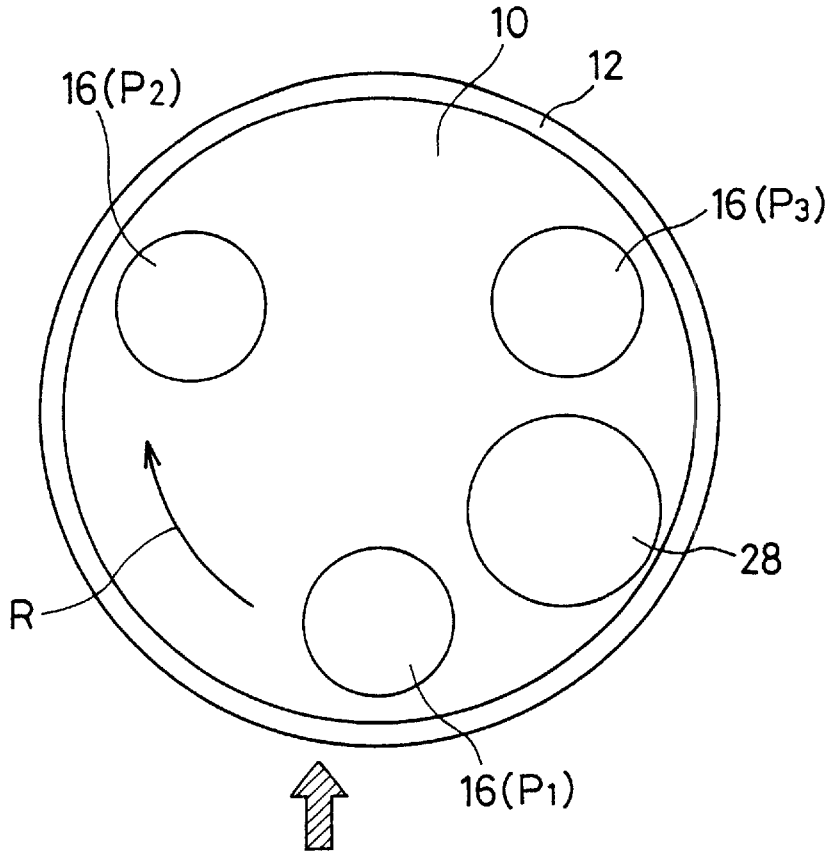
FIG. 2A is an enlarged plan view showing essential parts of the polishing apparatus shown in FIG. 1.
Figure 2B:
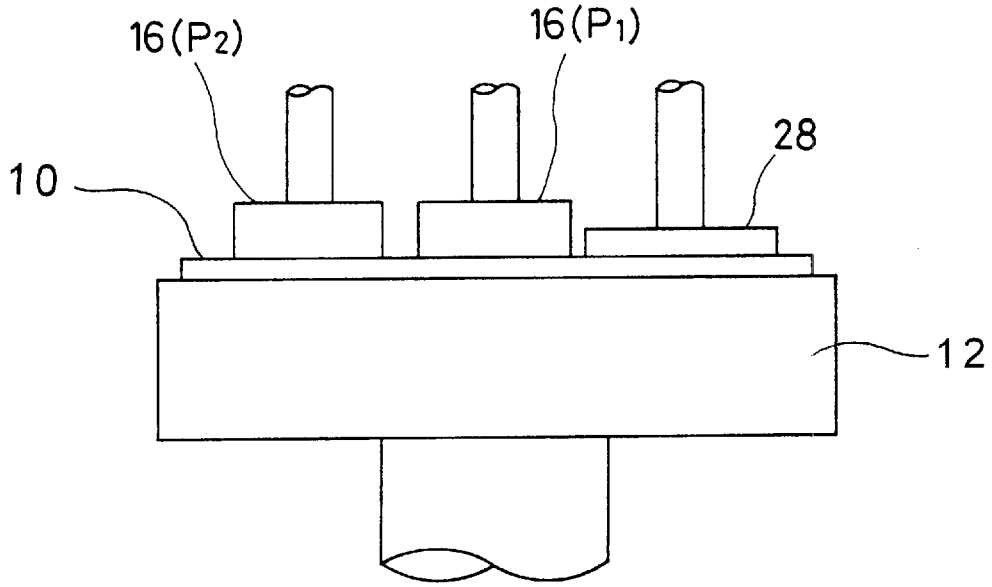
FIG. 2B is an enlarged side view showing essential parts of the polishing apparatus shown in FIG. 1.

In the polishing section A, semiconductor wafers W on three top rings 16 are polished about 120° out of phase each other. Specifically, as shown in FIG. 2A, a primary polishing of a semiconductor wafer W is carried out in a first polishing position $P_1$ which confronts the rotary transporter 26 on the polishing surface 10 of the polishing table 12 for a period of time that is about one-third of the total polishing time. Then, the top ring support assembly 18 is turned 120° to transfer the semiconductor wafer W to a second polishing position $P_2$ that is spaced 120° downstream from the first polishing position $P_1$ with respect to the direction in which the polishing table 12 is rotated, and then a secondary polishing of the semiconductor wafer W is carried out in the second polishing position $P_2$. Thereafter, the top ring support assembly 11 is further turned 120° to transfer the semiconductor wafer W to a third polishing position $P_3$ that is 120° spaced downstream from the second polishing position $P_2$ with respect to the direction in which the polishing table 12 is rotated, and then a tertiary polishing of the semiconductor wafer W is carried out in the third polishing position $P_3$. Since the first polishing position $P_1$ is also a semiconductor wafer transfer position, the period of time in which the semiconductor wafer W is polished in the first polishing position $P_1$ is shorter than the periods of time in which the semiconductor wafer W is polished in the second and third polishing positions $P_2$, $P_3$. Simultaneously with the polishing of the semiconductor wafer W, the polishing surface 10 is dressed by the dresser 28. As shown in FIGS. 2A and 2B, the dresser 28 has a substantially circular plate having a dressing surface at a lower surface. Diamond particles capable of dressing or conditioning the polishing surface are uniformly attached to the entire surface of the dressing surface of the dresser 28 by electrodeposition. Other dressers in other embodiments have the same dressing surface comprising electrodeposited diamond particles.

The operation of the polishing section A will be described in greater detail below. When the polishing of the semiconductor wafer W in the third polishing position $P_3$ is finished, the top ring 16 which carries the polished semiconductor wafer W is lifted, and the top ring support assembly 18 is turned 120° to bring the top ring 16 to a wafer transfer position, i.e., the first polishing position $P_1$. When the top ring support assembly 18 is turned, the dresser 28 is retracted out of the path of the top ring support assembly 18, as necessary. Then, the top ring 16 moves radially outward along the support arm 22 to a position above the pusher 24 located in the wafer transfer position near the polishing table 12. The top ring 16 is lowered by an air cylinder into abutment against the pusher 24 and transfers the polished semiconductor wafer W to the pusher 24. Then, the top ring 16 is lifted and waits in an upper standby position.

Depending on the polishing process, the semiconductor wafer holding surfaces of the top rings 16 from which semiconductor wafers W have been removed may be cleaned by a liquid such as pure water or a chemical solution ejected under a given pressure from a top ring cleaning nozzle (not shown). In addition, a cleaning liquid may be supplied to clean the liquid supply nozzle 14 depending on the polishing liquid or the polishing process. The feed robots 38, 40, the reversing machines 42, 44, and the rotary transporter 26 may have a self-cleaning mechanism for cleaning themselves with suitable timing depending on the polishing process.

After receiving the polished semiconductor wafer W from the top ring 16, the rotary transporter 26 is turned 180° to locate the pusher 24 that has received the polished semiconductor wafer W at the wafer transfer position near the cleaning section B and locate the pusher 24 that carries a semiconductor wafer W to be polished at the wafer transfer position near the polishing table 12. The top ring 16 is lowered from the upper standby position, receives the semiconductor wafer W to be polished under vacuum from the pusher 24, and is then lifted. Thereafter, the top ring 16 holding the semiconductor wafer W to be polished moves radially inward along the support arm 22 toward the center of the top ring support assembly 18 until the top ring 16 is positioned over the polishing surface 10 of the polishing table 12. When the angular movement of the rotary transporter 26 finishes, the dresser 28 returns from the retracted position to an operative position, and dresses the polishing surface 10.

The top ring 16 is lowered by the air cylinder to press the surface to be polished of the semiconductor wafer W held by the top ring 16 against the polishing surface 10 under a predetermined pressure, and starts polishing the semiconductor wafer W. During this time and also while the top ring support assembly 18 is rotating, the other two top rings 16 are continuously polishing semiconductor wafers W that are carried by these top rings 16. In order to rotate the top ring support assembly 18 smoothly, the top ring support assembly 18 may be lifted to space all the semiconductor wafers W held by the top rings 16 away from the polishing surface 10.

Before the top ring 16, which holds an unpolished semiconductor wafer W or a semiconductor wafer W in the process of being polished, is lowered to bring the surface to be polished of the semiconductor wafer W into contact with the polishing surface 10, the top ring 16 starts rotating. The polishing table 12 is rotated at all times during the polishing process. Therefore, the semiconductor wafer W is polished while the top ring 16 and the polishing table 12 are rotating. The polishing surface 10 is supplied with pure water or at least one polishing liquid (abrasive liquid) from the liquid supply nozzle 14 during the polishing process.

After the polishing of a semiconductor wafer W is finished, the polished semiconductor wafer W is transferred from the top ring 16 to the rotary transporter 26, and an unpolished semiconductor wafer W is transferred from the rotary transporter 26 to the top ring 16. As the polishing of the semiconductor wafers W held by the three top rings 16 is finished, the polished semiconductor wafers W are successively transferred from the top rings 16 to the rotary transporter 26 and unpolished semiconductor wafers W are successively transferred from the rotary transporter 26 to the top rings 16. During this operation, the polished and unpolished semiconductor wafers W are transferred between the rotary transporter 26 and the second robot 38. Specifically, the second robot 38 successively removes the polished semiconductor wafers W from the rotary transporter 26, and successively delivers the unpolished semiconductor wafers W to the rotary transporter 26.

In the polishing process, the polishing surface 10 of the polishing table 12 is steadily dressed by the dresser 28. The polishing surface 10 is fully regenerated in the first polishing position $P_1$, and the regenerated effect of the polishing surface 10 is reduced progressively in the second and third polishing positions $P_2$, $P_3$. Therefore, when a plurality of semiconductor wafers W are to be simultaneously polished, the polishing positions, depending on the remaining dressing effect on the polishing surface 10, may be selected to polish the semiconductor wafers W effectively.

Specifically, in the case where the polishing table 12 is a rotating-type polishing table, as shown in FIG. 2A and 2B, the polishing surface 10 has the most efficient polishing performance at the first polishing position $P_1$ immediately downstream of the dressing position, in a rotational direction R of the polishing table 12, where the dressing of the polishing surface 10 is performed by the dresser 28. The polishing surface 10 has less efficient polishing performance at the second and third polishing positions $P_2$, $P_3$, where deterioration of the polishing surface 10 progresses, because at least one of semiconductor wafers has been polished once. By utilizing these characteristics, the semiconductor wafers can be polished under different polishing conditions at different polishing positions $P_1$, $P_2$, $P_3$.

In the case where the polishing surface 10 comprises a fixed abrasive surface provided by the abrading plate which causes self-generation of abrasive particles during the polishing process, the abrasive particles are generated by dressing. In the first polishing position $P_1$, the polishing surface 10 polishes a semiconductor wafer W initially at a high polishing rate to remove large surface irregularities with the abundant abrasive particles available in the first polishing position. In the second polishing position $P_2$, the polishing surface 10 polishes the semiconductor wafer W secondarily at a medium polishing rate. In the third polishing position $P_3$, the polishing surface 10 conducts a finish polishing of the semiconductor wafer W.

In the illustrated embodiment, a semiconductor wafer W is successively moved in one direction to the three polishing positions $P_1$, $P_2$, $P_3$ and successively polished in the three polishing positions. However, the semiconductor wafer W may be moved in different patterns. For example, the semiconductor wafer W may be moved back from the third polishing position $P_3$ to the second polishing position $P_2$. Alternatively, semiconductor wafers W of different types may be polished only in their respective polishing positions.

In the polishing apparatus, it may be desirable to remove the same amount of material from the semiconductor wafers in the respective polishing positions $P_1$, $P_2$, $P_3$. This may be achieved by changing the polishing pressure applied by the top rings 16, and/or the rotational speed, i.e., the sliding speed, of the top rings 16. For example, the polishing pressure and/or the rotational speed of the top ring 16 is reduced in the first polishing position $P_1$ where the dressing effect remains large, and is increased in the second and third polishing positions $P_2$, $P_3$ where the dressing effect remains small, for thereby eliminating nonuniformity in the amount of material to be removed among the semiconductor wafers held by the top rings 16. As described above, the polishing pressure and/or the rotational speeds of the top rings 16 are adjusted in order to uniformize the polishing rates in the respective polishing positions $P_1$, $P_2$, $P_3$. However, the polishing pressure and/or the rotational speeds of the top rings 16 may be adjusted to intentionally make the polishing rates in the respective polishing positions $P_1$,$P_2$, $P_3$ different.

Further, in this polishing apparatus, the amount of dressing may be adjusted according to the number of semiconductor wafers which have been polished. For example, while replacement of the semiconductor wafer is carried out in one of the three top rings 16, the degree of deterioration of the polishing surface 10 on the polishing cloth or the amount of self-generated abrasive particles required for polishing in the abrading plate may be two-thirds of the case in which the three top rings 16 perform polishing operation. Therefore, in this case, the dressing load may be reduced to prevent the polishing cloth from being dressed excessively or to prevent the abrading plate from being worn excessively.

The polished semiconductor wafer W removed from the rotary transporter 26 by the second robot 38 is delivered to a cleaning process in the cleaning section B. Specifically, the second robot 38 removes the polished semiconductor wafer W with its hand for holding a wet semiconductor wafer W, turns 180°, and transfers the polished semiconductor wafer W to the second reversing machine 44 for reversing a wet semiconductor wafer W.

The polished semiconductor wafer W is cleaned in the cleaning B section as follows. The semiconductor wafer W transferred to the second reversing machine 44 by the second robot 38 is reversed to cause the polished surface to face upward. The reversed semiconductor wafer W is then removed laterally from the second reversing machine 44 by the third robot 40 that is movable. The third robot 40 which has received the semiconductor wafer W moves to the position confronting the first cleaning unit 32, and transfers the semiconductor wafer W to the first cleaning unit 32. The third robot 40 uses its hand for holding a wet semiconductor wafer W to transfer the semiconductor wafer W to the first cleaning unit 32. In the first cleaning unit 32, the rollers 46 hold the circumferential edge of the semiconductor wafer W and rotate the semiconductor wafer W at a relatively low speed, and the sponge rolls 48, which are rotating, clean both surfaces of the semiconductor wafer W while the semiconductor wafer W is rotating at the relatively low speed.

After the semiconductor wafer W is cleaned in the first cleaning unit 32, the third robot 40 removes the cleaned semiconductor wafer W from the first cleaning unit 32, carries the cleaned semiconductor wafer W to the second cleaning unit 34, and transfers the cleaned semiconductor wafer W to the second cleaning unit 34. In the second cleaning unit 34, the holder 50 holds the semiconductor wafer W, and a jet of cleaning liquid is applied to both surfaces or the polished surface of the semiconductor wafer W to clean the semiconductor wafer W while the holder 50 is rotating at a relatively high speed.

After the semiconductor wafer W is cleaned in the second cleaning unit 34, the third robot 40 removes the cleaned semiconductor wafer W from the second cleaning unit 34, carries the cleaned semiconductor wafer W to the third cleaning unit 36, and transfers the cleaned semiconductor wafer W to the third cleaning unit 36. The third robot 40 uses its hand for holding a wet semiconductor wafer W to transfer the semiconductor wafer W to the third cleaning unit 36. In the third cleaning unit 36, the holder 50 holds the semiconductor wafer W, and the polished surface of the semiconductor wafer W is cleaned with a pencil-shaped sponge member while the holder 50 is rotating at a relatively high speed, after which the semiconductor wafer W is rotated at a high speed to dry the semiconductor wafer W by way of a spin dry process.

After the semiconductor wafer W is cleaned and dried in the cleaning section B, the semiconductor wafer W is removed from the third cleaning unit 36 by the hand for a dry semiconductor wafer in the third robot 40 and then returned to the wafer cassette C from which the semiconductor wafer W was supplied, by the first robot 56 in the loading/unloading section D. Therefore, semiconductor wafers W are processed by a dry-in and dry-out process in the polishing apparatus, and then delivered to a next process in the clean room.

Figure 3:
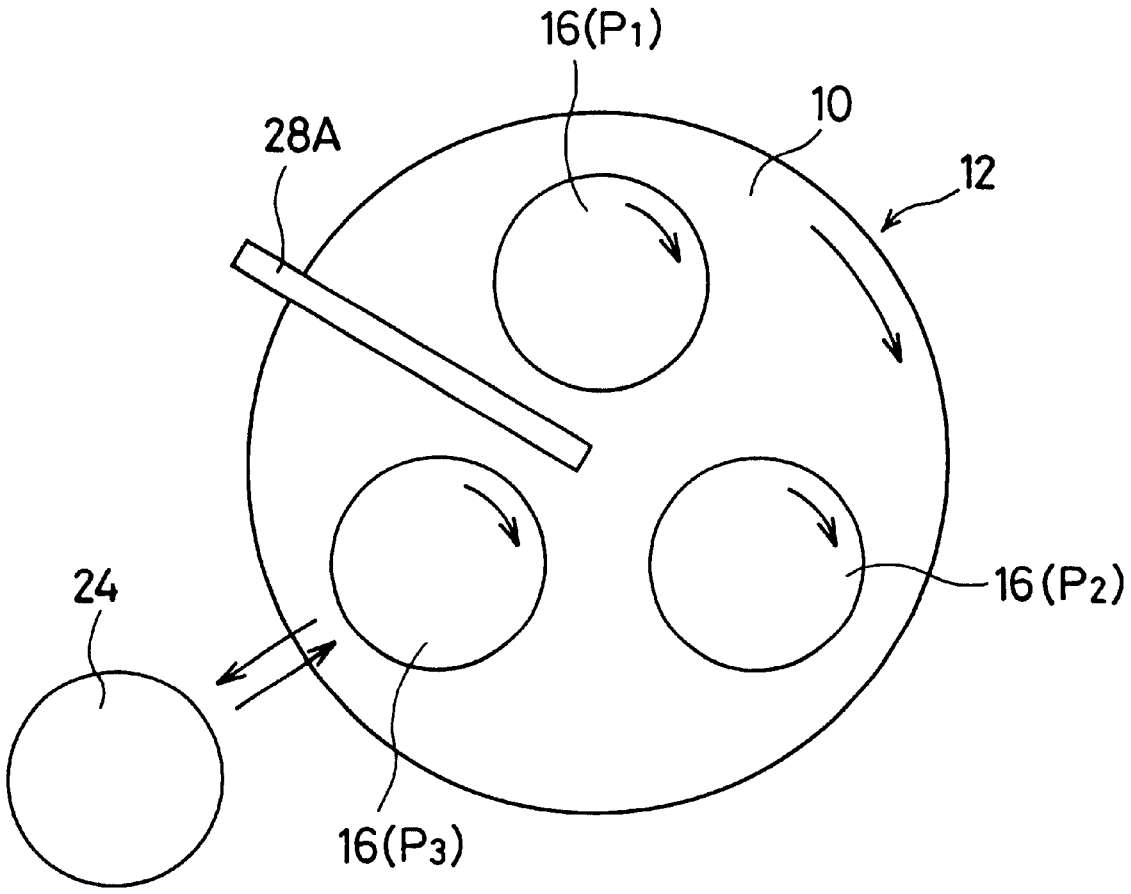
FIG. 3 is a plan view of a polishing apparatus according to a modified embodiment of the polishing apparatus shown in FIG. 1.

FIG. 3 shows a polishing apparatus according to a modified embodiment of the polishing apparatus shown in FIG. 1. In this embodiment, a dresser 28A comprises a bar-like dresser (dressing rod) or a plate-like dresser (dressing plate) having a suitable cross-section, in place of a rotating disk-type of dresser. The dresser 28A has both ends pressed by a pressing device, such as an air cylinder, whereby the dresser 28A is brought in sliding contact with the polishing surface 10 on the polishing table 12. The dressing surface of the dresser 28A may comprise a suitable material and a suitable shape. The dresser 28A may comprise a roller having a circular cross-section which can dress the polishing surface while the roller is rotating about its own axis. Although the dresser 28A has a shape and an arrangement different from the dresser 28, other structures in the dresser 28A shown in FIG. 3 are the same as those in FIGS. 1 and 2.

Figure 4A:
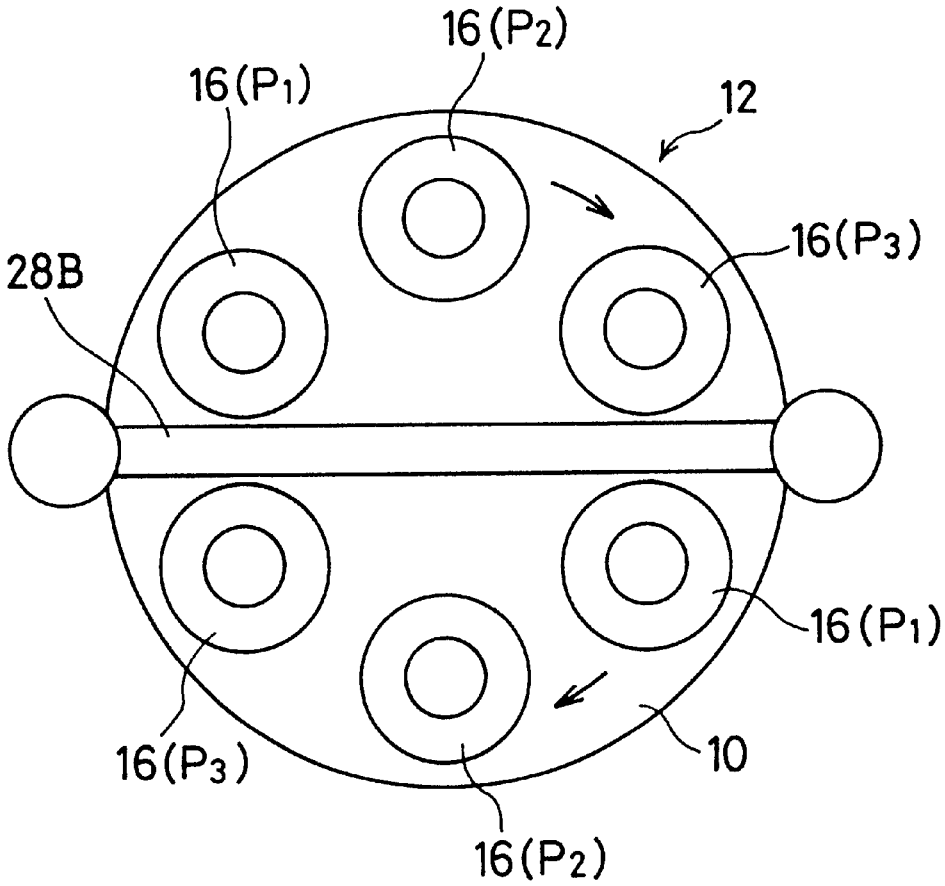
FIGS. 4A and 4B are views showing a polishing apparatus according to another modified embodiment of the polishing apparatus shown in FIG. 1.
Figure 4B:
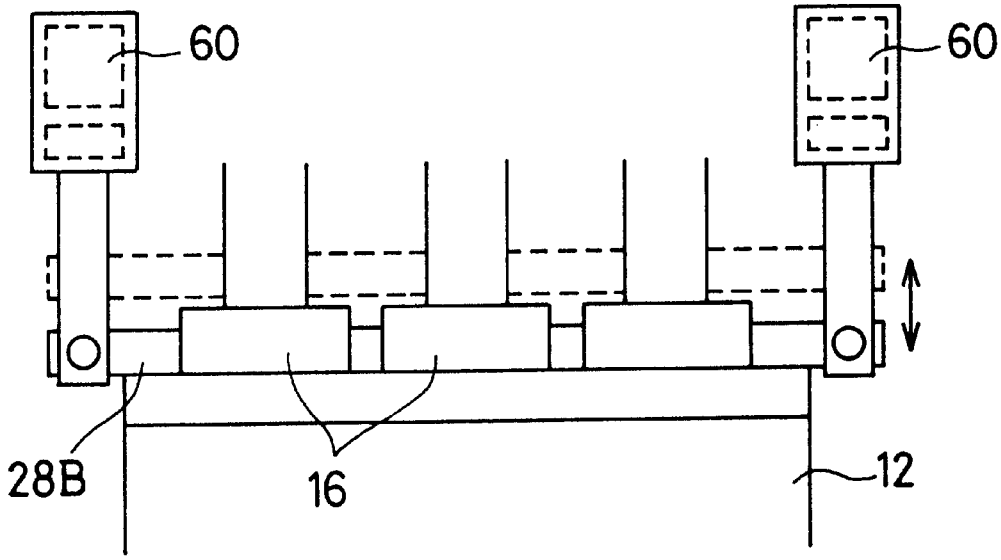

FIGS. 4A and 4B show a polishing apparatus according to another modified embodiment of the present invention. In this embodiment, the top ring support assembly (not shown) supports six top rings 16 so that six semiconductor wafers W can be polished simultaneously. A dresser 28B is provided so as to be laid diametrically across the polishing table 12. The dresser 29B has both ends connected to air cylinders 60, and is pressed downward by the air cylinders 60. Therefore, in this embodiment, the first through third polishing position $P_1$, $P_2$, and $P_3$ are arranged in two rows.

Figure 5:
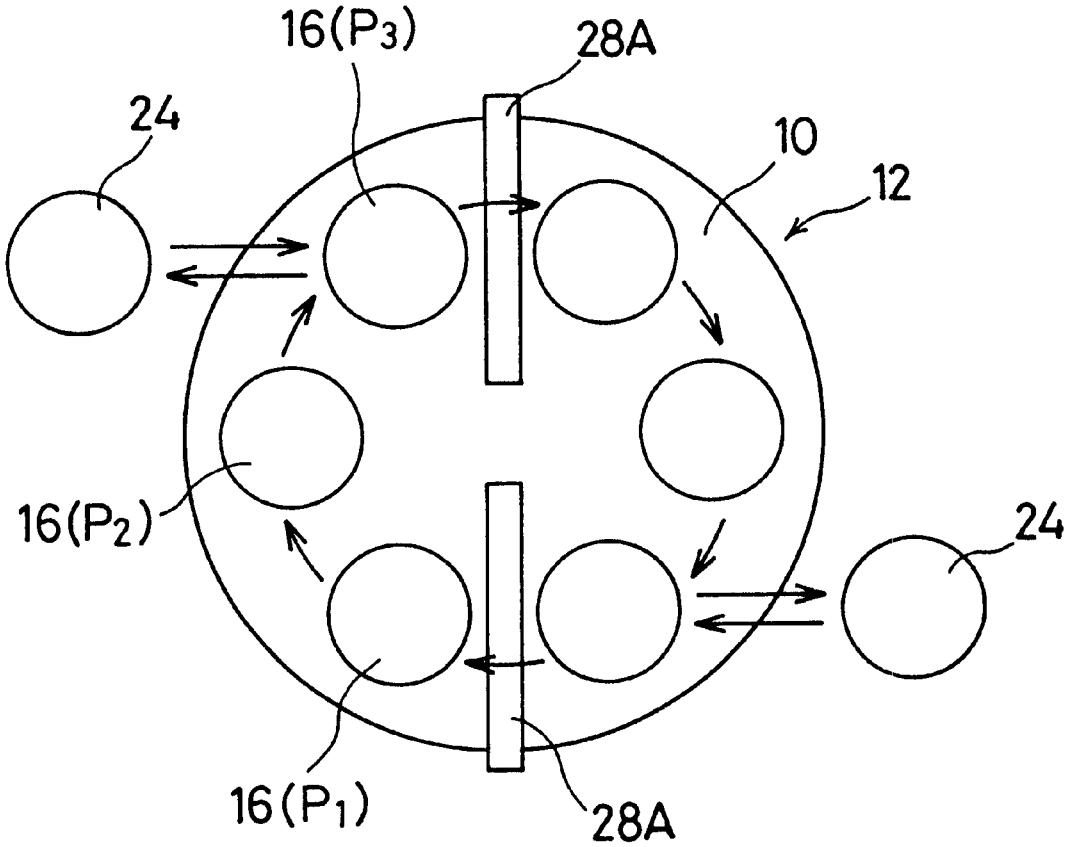
FIG. 5 is a plan view of a polishing apparatus according to still another modified embodiment of the polishing apparatus shown in FIG. 1.

Further, FIG. 5 shows a polishing apparatus according to a modified embodiment. The polishing apparatus in this embodiment is different from that in FIGS. 4A and 4B in that two dressers 28A each comprising a dressing rod are provided so as to extend radially from a position close to a center of the polishing table 12 to the periphery of the polishing table 12.

Figure 6:
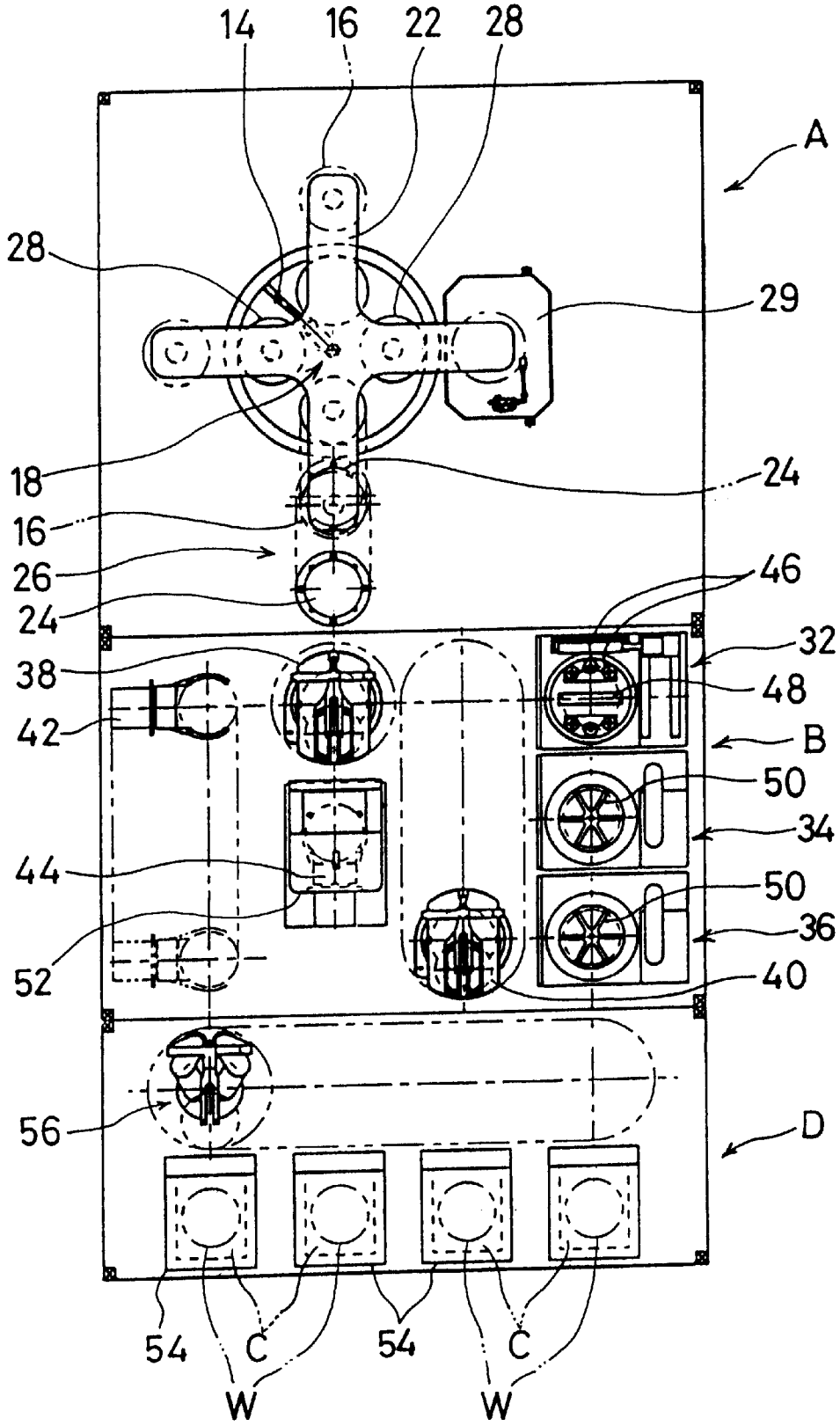
FIG. 6 is a plan view showing a whole structure of a polishing apparatus according to a second embodiment of the present invention.

FIG. 6 shows a polishing apparatus according to a second embodiment of the present invention. The polishing apparatus according to the second embodiment has a cleaning section B and a loading/unloading section D Which are identical to those of the polishing apparatus according to the first embodiment, and a polishing section A which differs from that of the polishing apparatus according to the first embodiment.

The polishing apparatus has a top ring support body 18 having four support arms 22 each for supporting either a top ring 16 or a dresser 28. That is, two top rings 16 and two dressers 28 are provided on the support arms 22, and the top rings 16 and the dressers 28 are alternately provided in a circumferential direction of the polishing table 12. The top rings 16 and the dressers 28 are radially movable along the support arms 22 which support them. Thus, one dresser 28 is provided so as to correspond to one top ring 16, and hence, the polishing surface 10 has the same polishing condition at respective polishing positions of the respective top rings 16. Therefore, the semiconductor wafers can be polished in a uniform quality, and the process control can be easily conducted.

In this embodiment, a cleaning container 29 for cleaning the dresser 28 is disposed at a standby position adjacent to a transfer position of the semiconductor wafer which is located in confrontation with the rotary transporter 26. Therefore, while the top ring 16 performs the replacement work of the semiconductor wafer, the dresser 28, located upstream of the top ring 16 which performs the replacement work, is positioned in the cleaning container 29 in which ground-off particles and the like can be removed by a certain cleaning mechanism.

In this embodiment, three top rings 16 may be supported by the three support arms among four support arms, and one dresser 28 may be supported by remaining support arm. This structure allows throughput of semiconductor wafers to be increased. In this case, although the polishing surface 10 has different conditions among three top rings 16, an adverse effect caused by the different conditions may be removed by an accurate endpoint detection of polishing.

When the polishing of the semiconductor wafer finishes by one of the top rings 16, the top ring support assembly 18 is turned, and the top ring 16 which carries the polished semiconductor wafer W is moved to the wafer transfer position where the polished semiconductor wafer W is replaced with an unpolished semiconductor wafer W. Unlike the polishing apparatus according to the first embodiment, in addition to polishing of the semiconductor wafers by other top rings, the polishing surface can be dressed by the dresser 28 while the top ring support assembly 18 is being turned.

Figure 7:
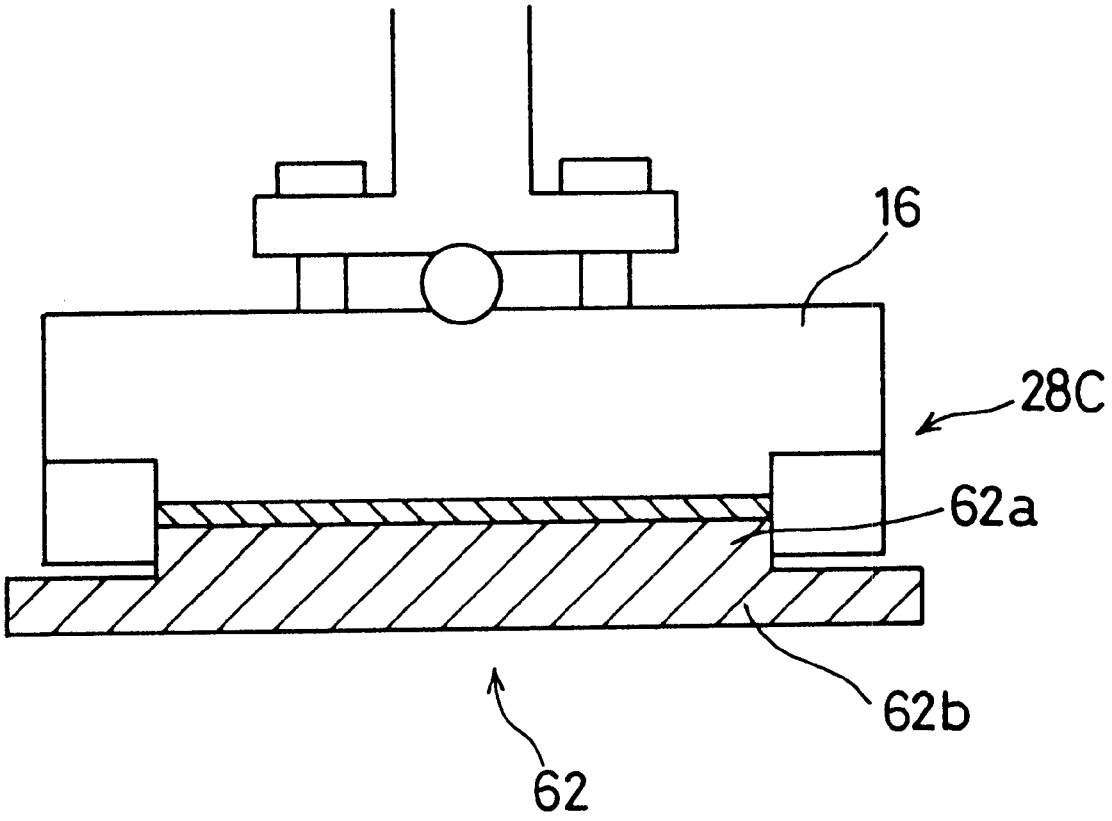
FIG. 7 is a cross-sectional view of a polishing apparatus according to a modified embodiment of the polishing apparatus shown in FIG. 6.

As shown in FIG. 7, a dresser 28C may comprise a top ring 16. Specifically, the dresser 28C comprises a dressing tool 62 including an attachment portion 62*a* having a small diameter, and a dressing portion 62*b* having a large diameter. The lower surface of the dressing portion 62*b* serves as a dressing surface. This structure allows the top ring 16 to hold the dressing tool 62 instead of the semiconductor wafer, thus forming the dresser 28C, as required.

Figure 8:
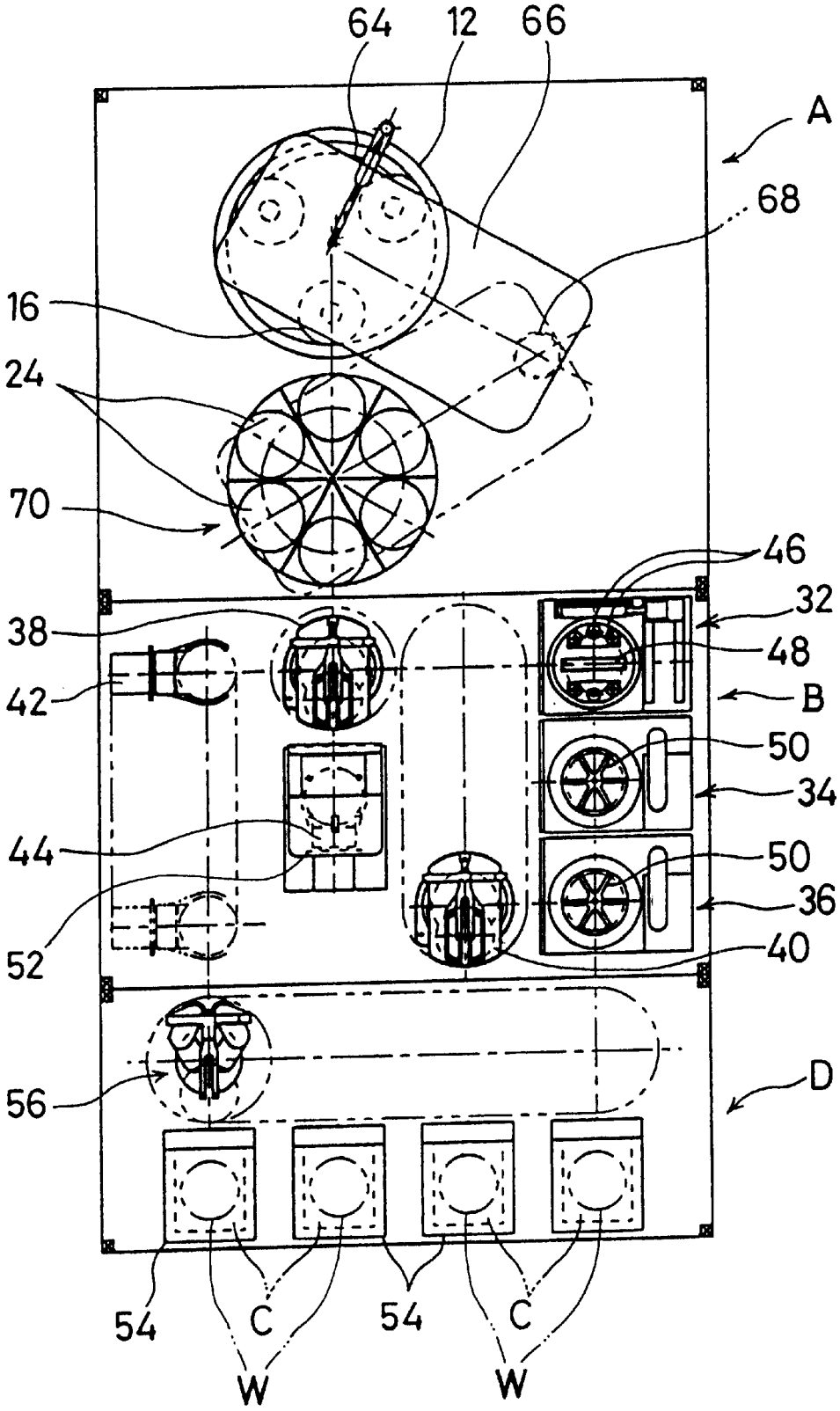
FIG. 8 is a plan view showing a whole structure of a polishing apparatus according to a third embodiment of the present invention.

FIG. 8 shows a polishing apparatus according to a third embodiment of the present invention. The polishing apparatus according to the third embodiment hag a cleaning section B and a loading/unloading section D which are identical to those of the polishing apparatus according to the first embodiment, and a polishing section A which differs from that of the polishing apparatus according to the first embodiment.

As shown in FIG. 8, the polishing section A has a plurality of top rings 16 and one or more dressers 28 which are mounted on a support member 64. The support member 64 is rotatable in a horizontal plane about its own axis, and the top rings 16 and the dresser (or dressers) 28 are disposed around the axis of the support member 64. The support member 64 is mounted on a distal end of a swing head 66 that is rotatable in a horizontal plane. In this embodiment, the three top rings are provided at equal angular intervals, and one or more (three at the maximum) dressers 28 may be provided go as to locate each dresser 28 between two top rings. The swing head 66 is supported at its proximal end by a support post 68. The support arm 22 has motors and air cylinders for individually rotating the top ring 16 and the dresser 28 and moving the top ring 16 and the dresser 28 vertically.

The polishing section A also has a rotary transporter 70 having six pushers 24 which alternately hold unpolished semiconductor wafers W and polished semiconductor wafers W. When the swing head 66 is turned about the support post 68, each of the top rings 16 can move to a position over the rotary transporter 70 for attachment of a semiconductor wafer W to and removal of a semiconductor wafer W from the top ring 16.

In the third embodiment, unpolished semiconductor wafers W are simultaneously installed on the three top rings 16 and also simultaneously polished in a batch process. Specific operation of the polishing apparatus according to the third embodiment will be described below. The process of carrying an unpolished semiconductor wafer W with the second robot 38 to the polishing section A is identical to the corresponding process carried out by the polishing apparatus according to the first embodiment.

The second robot 38 that has received the semiconductor wafer W from the first reversing machine 42 with the hand for holding a dry semiconductor wafer W is turned so as to face the rotary transporter 70, and transfers the semiconductor wafer W to a first loading pusher 24 on the rotary transporter 70. Each time the rotary transporter 70 receives a semiconductor wafer W, the rotary transporter 70 is turned 120° clockwise. The above process is repeated twice. Therefore, unpolished semiconductor wafers W are placed respectively on three loading pushers (first, second, and third loading pushers) 24 on the rotary transporter 70.

Then, the swing head 66 is turned to place the three top rings 16 over the rotary transporter 70. The rotary transporter 70 is turned 60° clockwise to position the three loading pushers 24 thereon in alignment with the three top rings 16, respectively. The air cylinders for vertically moving the top rings 16 are actuated to lower the top rings 16, and then the top rings 16 hold the unpolished semiconductor wafers W under vacuum on the three loading pushers 24. The top rings 16 that have received the semiconductor wafers W are lifted, and the swing head 66 is turned to bring the top rings 16 over the polishing surface of the polishing table 12. The top rings 16 and the dresser 28 are lowered, and the semiconductor wafers W supported by the top rings 16 are polished by the polishing surface 10 of the polishing table 12, while the polishing surface 10 is dressed by the dresser 28. The number of dressers and arrangement of the dressers with respect to the top rings 16 are the same as the polishing apparatus shown in FIG. 6.

While the semiconductor wafers W are being polished, the semiconductor wafers W that have been polished and placed on the unloading pushers 24 on the rotary transporter 70 are discharged by the second robot 38, and semiconductor wafers to be polished next are supplied to the loading pushers 24 on the rotary transporter 70 according to the process described above.

When the polishing of the semiconductor wafers W is completed, the top rings 16 are elevated, and the swing head 66 is turned to position the top rings 16 over the rotary transporter 70 where the three unloading pushers 24 are positioned in alignment with the respective top rings 16. The top rings 16 are lowered into abutment against the unloading pushers 24, and transfer the polished semiconductor wafers W to the unloading pushers 24.

After transferring the polished semiconductor wafers W to the unloading pushers 24, the top rings 16 are lifted to a predetermined position, after which the rotary transporter 70 is turned 60° clockwise to position the loading pushers 24 thereon in alignment with the top rings 16. The top rings 16 are lowered to receive unpolished semiconductor wafers W from the loading pushers 24. Thereafter, the top rings 16 are lifted, and the swing head 66 is turned to position the top rings 16 over the polishing surface 10, after which the top rings 16 are lowered to polish the semiconductor wafers W.

The polished semiconductor wafers W that have been held by the unloading pushers 24 are successively removed from the unloading pushers 24 by the second robot 38, and transferred to the cleaning process in the cleaning section B. At this time, the second robot 38 delivers the polished semiconductor wafers W one by one. Specifically, the second robot 38 receives a polished semiconductor wafer W from a corresponding unloading pusher 24 with its hand for holding a wet semiconductor wafer W, is turned 180°, and transfers the received polished semiconductor wafer W to the second reversing machine 44.

During this time, the rotary transporter 70 is turned 120° clockwise to orient an unloading pusher 24, which is still holding a polished semiconductor wafer W toward the second robot 38. The second robot 38, which has transferred the semiconductor wafer W to the second reversing machine 44, is turned 180° to face the rotary transporter 70 again, receives the next polished semiconductor wafer W, and transfers the received semiconductor wafer W to the second reversing machine 44. The same process is repeated once more to deliver three semiconductor wafers W that have been simultaneously polished in one polishing process, successively to the cleaning section B. The process of cleaning of the polished semiconductor wafers W in the cleaning section B and the subsequent process are identical to the corresponding processes performed by the polishing apparatus according to the first embodiment.

Figure 9A:
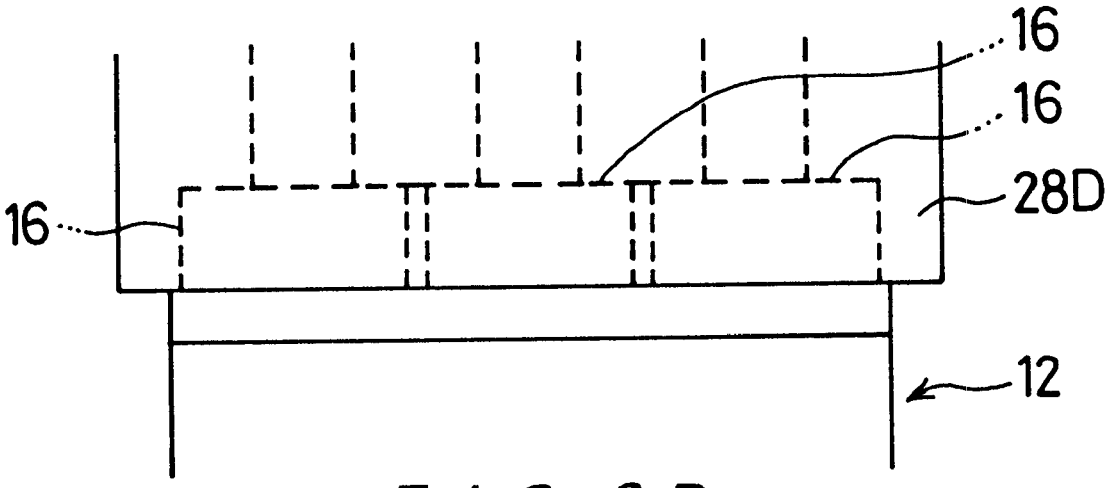
FIGS. 9A and 9B are views showing a polishing apparatus according to a modified embodiment of the polishing apparatus shown in FIG. 8.
Figure 9B:
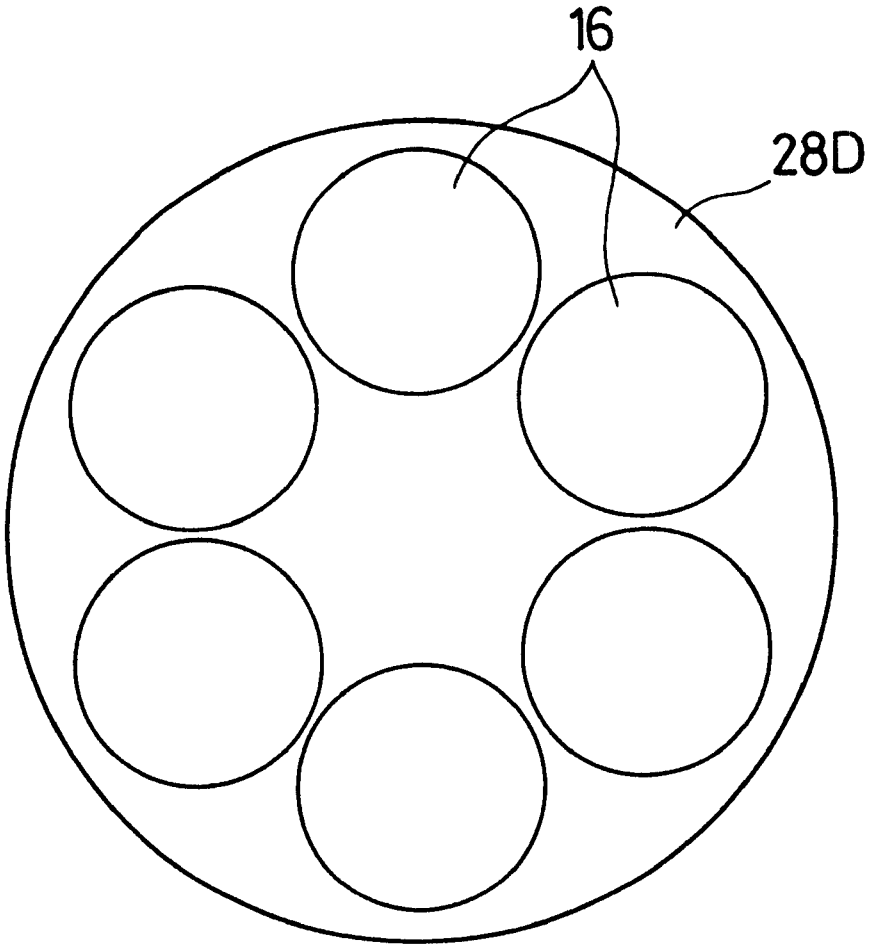

FIGS. 9A and 9B show a polishing apparatus according to another embodiment of the present invention. In this embodiment, six top rings 16 are provided on the swing head 66 shown in FIG. 8. Further, a disk-like dressing plate 28D having substantially the same diameter as the polishing table 12 is provided, and the dressing plate 28D has holes at positions corresponding to the respective top rings 16. The dressing plate 28D is attached to the swing head 66 through an air cylinder or the like, so that the dressing plate 28D is capable of being vertically moved and pressed against the polishing table 12, separately from the top rings 16.

In this apparatus, when six semiconductor wafers W are polished simultaneously, by pressing the dressing plate 28D constituting a dresser against the polishing surface 10 under a given pressure, the amount of material removed from the polishing surface 10 is uniformized over the entire polishing surface. Particularly, in the case where the polishing surface 10 comprises an abrading plate, i.e., a fixed abrasive plate, the shaping process of the surface of the abrading plate may be omitted. In the embodiment, although the dressing plate 28D is supported by the swing head 66, the dressing plate 28D may be supported by the top ring support assembly 18 shown in FIGS. 1 and 6.

Figure 10A:
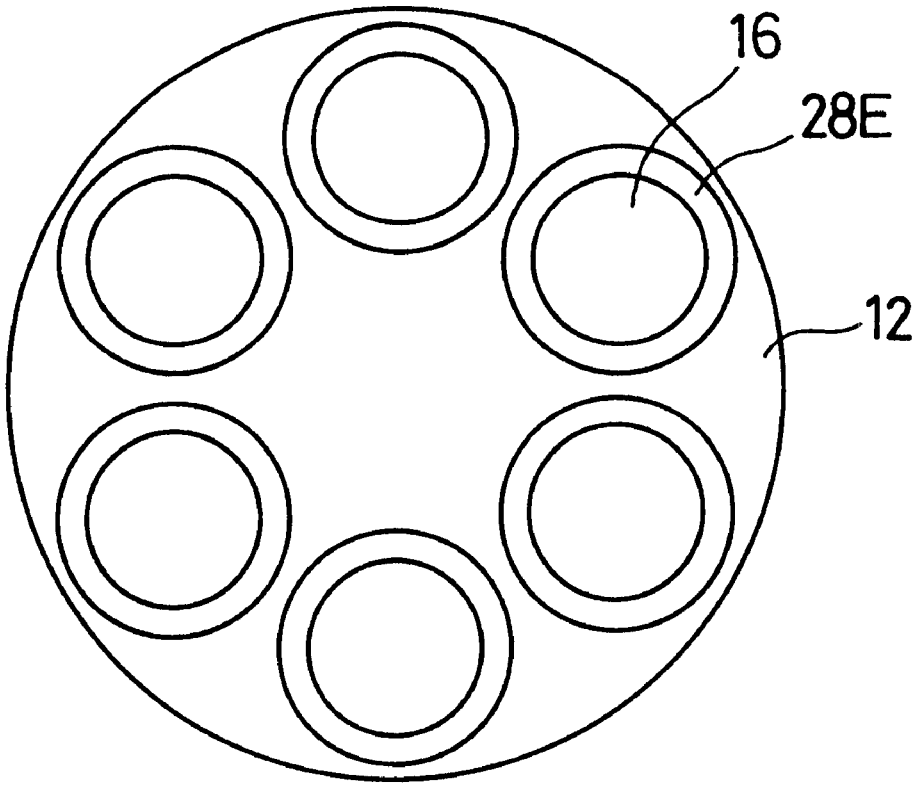
FIGS. 10A and 10B are views showing a polishing apparatus according to another modified embodiment of the polishing apparatus shown in FIG. 8.
Figure 10B:
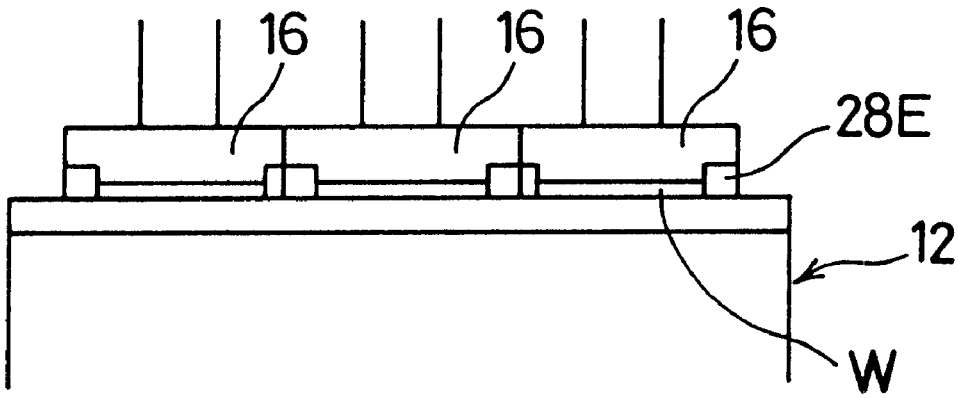

FIGS. 10A and 10B show a polishing apparatus according to still another embodiment. In this embodiment, six top rings 16 are provided on the swing head 66 shown in FIG. 8. Further, a ring-shaped dresser 28E (dressing ring) is provided on the outer peripheral portion of each of the top rings 16. In this embodiment, the dresser 28E is attached to the top ring 16 through a film (not shown in the drawing) having a desired elasticity. The dresser 28E may be supported by a spring or an actuator such as an air cylinder.

According to this embodiment, by a relatively simple structure of the dresser, areas on the polishing surface 10 where dressing is required can be reliably dressed by utilizing rotation of the top ring 16. The dresser 28E may have such a structure that the dresser 28E is not corotated with the top ring 16. Also in this embodiment, the dressers 28E may be supported by the top ring support assembly 18 shown in FIGS. 1 and 6.

Figure 11A:
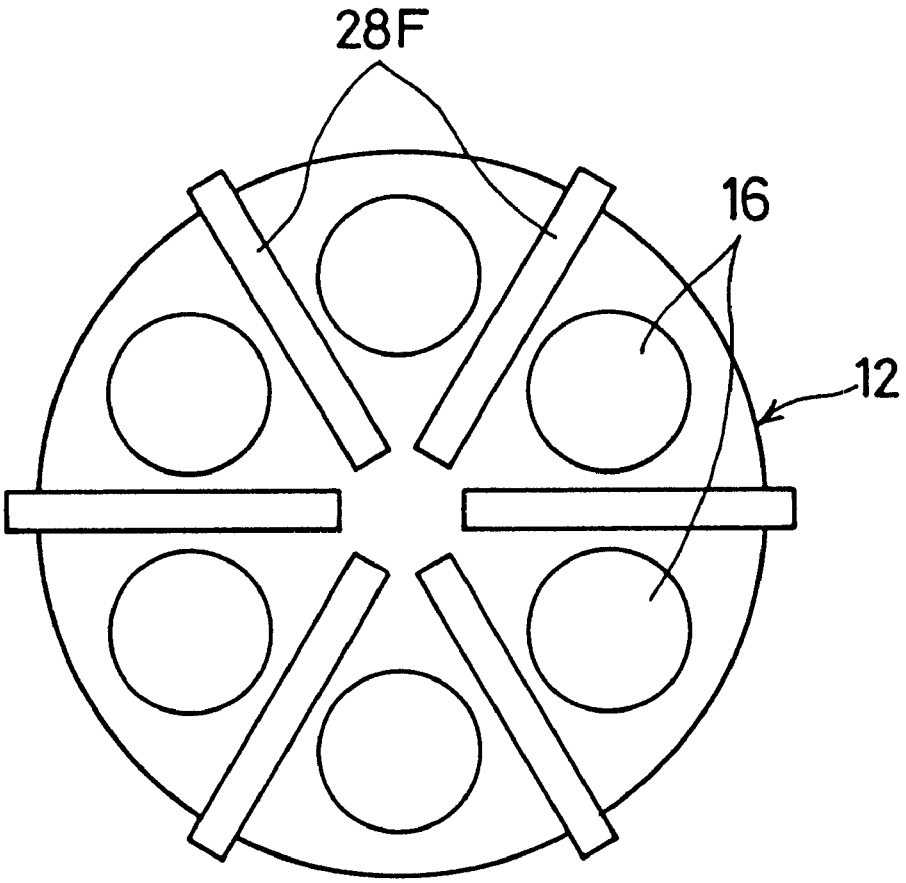
FIGS. 11A and 11B are views showing a polishing apparatus according to still another modified embodiment of the polishing apparatus shown in FIG. 8.
Figure 11B:
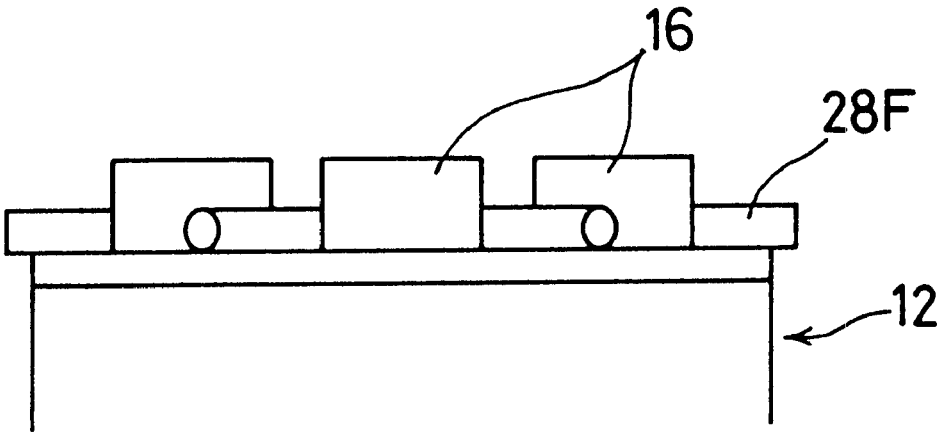

FIGS. 11A and 11B shows a polishing apparatus according to still another embodiment of the present invention. In this embodiment, six top rings 16 are provided on the swing head 66 shown in FIG. 8, and six dressers 28F are provided between adjacent top rings 16, so as to extend radially. The dresser 28F comprises a rod-like member (dressing rod) or a plate-like member (dressing plate). The dressers 28F are integrally attached to a single attachment member (not shown in the drawing), or are individually attached to the swing head 66 through actuators such as air cylinders. The basic operation of the polishing apparatus in FIGS. 11A and 11B is the same as that of the polishing apparatus in FIGS. 9A and 9B. The dressers 28F may be supported by the top ring support assembly 18 shown in FIGS. 1 and 6.

Figure 12:
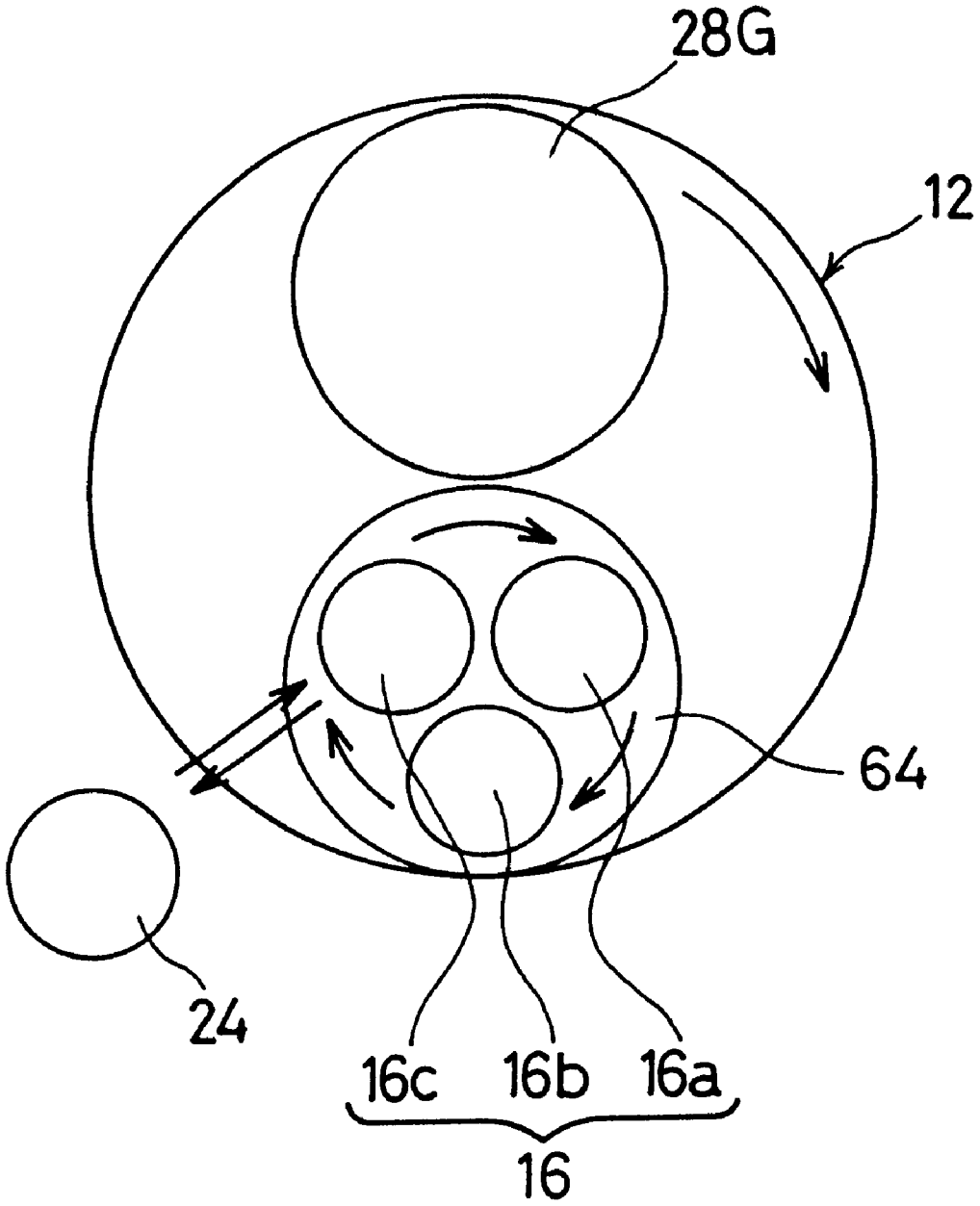
FIG. 12 is a plan view showing a polishing apparatus according to still another modified embodiment of the polishing apparatus shown in FIG. 8.

FIG. 12 shows a polishing apparatus according to still another embodiment of the present invention. In this embodiment, a support member 64 having a diameter substantially equal to the radius of the polishing table 12 is provided on the swing head 66 shown in FIG. 8, and three top rings 16 are provided on the support member 64. Further, a dresser 28G having a dressing surface with a diameter substantially equal to the radius of the polishing table 12 is swingably provided adjacent to the support member 64. In this embodiment, a pusher 24 is disposed adjacent to the polishing table 12, and the top ring 16 is movable over the pusher 24 by rotation of the swing head 66 for thereby replacing the semiconductor wafer W with a new one.

According to this embodiment, an initial polishing of the semiconductor wafer is conducted at a position of the top ring 16*a* because the top ring 16*a* is closest to the dresser 28G, a secondary polishing of the semiconductor wafer is conducted at the position of the top ring 16*b,* and a finish polishing of the semiconductor wafer is conducted at a position of the top rig 16*c,* because a position of the top ring 16*c* is farthest from the dresser 28G. That is, by rotating the support member 64 properly, the polishing process from the initial polishing to the finish polishing can be performed on the single polishing table.

As described above, according to the present invention, when workpieces such as semiconductor wafers are polished by utilizing a polishing surface efficiently, even if a deteriorating rate of the polishing surface is high, the workpieces can be efficiently polished to a high degree of flatness while forming a good polishing surface at all times and regenerating the polishing surface by dressing. Therefore, throughput per unit time and unit installation area in a clean room requiring an expensive operating cost can be improved.

Although certain preferred embodiments of the present invention have been shown and described in detail, it should be understood that various changes and modifications may be made therein without departing from the scope of the appended claims.

What is claimed is:

1. A polishing apparatus for polishing a surface of a workpiece, said polishing apparatus comprising:

a polishing table having a polishing surface thereon;

a plurality of workpiece holders, each of said plurality of workpiece holders being operable to hold a workpiece and press the workpiece against said polishing surface; and a dresser having a dressing surface for dressing said polishing surface by pressing said dressing surface against a desired position of said polishing surface, wherein at least two workpieces are polished by being pressed against said polishing surface with at least two of said plurality of workpiece holders while said polishing surface is being dressed by said dresser.

2. A polishing apparatus according to claim 1, wherein said polishing surface has a plurality of polishing positions which have different dressing effects.

3. A polishing apparatus according to claim 2, wherein the plurality of workpieces are sequentially polished by moving the plurality of workpieces to said plurality of polishing positions sequentially.

4. A polishing apparatus according to claim 3, wherein an initial polishing of each of the plurality of workpieces is conducted at one of said plurality of polishing positions where a dressing effect remains large, and a secondary polishing or a finish polishing of each of the plurality of workpieces is conducted at another of said plurality of polishing positions where a dressing effect remains small.

5. A polishing apparatus according to claim 1, wherein at least one of polishing pressure and rotational speed applied to each of the plurality of workpieces by said plurality of workpiece holders is controlled based on a dressing effect remaining on said polishing surface.

6. A polishing apparatus according to claim 1, wherein said polishing surface has a plurality of polishing positions, and dressing effects on said plurality of polishing positions by said dresser are equal to one another.

7. A polishing apparatus according to claim 6, further comprising at least one additional dresser, such that a number of said dressers corresponds to a number of said plurality of workpiece holders.

8. A polishing apparatus according to claim 1, wherein said dresser dresses an entire surface of said polishing surface.

9. A polishing apparatus according to claim 1, wherein said polishing surface comprises a polishing cloth.

10. A polishing apparatus according to claim 1, wherein said polishing surface comprises a fixed abrasive plate.

11. A polishing apparatus for polishing a surface of a workpiece, said polishing apparatus comprising:

a polishing table having a polishing surface thereon;

a plurality of workpiece holders, each of said plurality of workpiece holders being operable to hold a workpiece and press the workpiece against said polishing surface; and a dresser having a dressing surface for dressing said polishing surface by pressing said dressing surface against a desired position of said polishing surface;

wherein at least two workpieces are polished by being pressed against said polishing surface with at least two of said plurality of workpiece holders while said dresser dresses said polishing surface, and a dressing load is adjusted according to a number of workpiece being polished.

12. A polishing apparatus according to claim 11, wherein said polishing surface has a plurality of polishing positions which have different dressing effects, an initial polishing of each of the plurality of workpieces is conducted at one of said plurality of polishing positions where a dressing effect remains large, and a secondary polishing or a finish polishing of each of the plurality of workpieces is conducted at another of said plurality of polishing positions where a dressing effect remains small.

13. A polishing apparatus according to claim 11, wherein at least one of polishing pressure and rotational speed applied to each of the plurality of workpieces by said plurality of workpiece holders is controlled based on a dressing effect remaining on said polishing surface.

14. A polishing apparatus according to claim 11, wherein said polishing surface has a plurality of polishing positions, and dressing effects on said plurality of polishing positions by said dresser are equal to one another.

15. A polishing apparatus according to claim 11, further comprising at least one additional dresser, such that a number of said dressers corresponds to a number of said plurality of workpiece holders.

16. A polishing apparatus according to claim 11, wherein said dresser dresses an entire surface of said polishing surface.

17. A polishing apparatus according to claim 11, wherein said polishing surface comprises a polishing cloth.

18. A polishing apparatus to claim 11, wherein said polishing surface comprises a fixed abrasive plate.

19. A polishing apparatus for polishing a surface of a workpiece, said polishing apparatus comprising:

a polishing table having a polishing surface thereon;

a plurality of workpiece holders, each of said plurality of workpiece holders being operable to hold a workpiece and press the workpiece against said polishing surface; and a dresser having a dressing surface for dressing said polishing surface by pressing said dressing surface against a desired position of said polishing surface, said dresser being held by one of said plurality of workpiece holders.

20. A polishing apparatus according to claim 19, wherein said polishing surface comprises a polishing cloth.

21. A polishing apparatus according to claim 19, wherein said polishing surface comprises a fixed abrasive plate.

22. A polishing apparatus according to claim 19, wherein a diameter of said dresser is substantially the same as a diameter of said polishing table.

23. A polishing apparatus for polishing a surface of a workpiece, said polishing apparatus comprising:

a polishing table having a polishing surface thereon;

a plurality of workpiece holders, each of said plurality of workpiece holders being operable to hold a workpiece and press the workpiece against said polishing surface; and a plurality of dressers each having a dressing surface for dressing said polishing surface by pressing said plurality of dressing surfaces against desired positions of said polishing surface, a number of said plurality of dressers being equal to a number of said plurality of workpiece holders, wherein each of said plurality of dressers comprises one of a rod-like member and a plate-like member.

24. A polishing apparatus according to claim 23, wherein said polishing surface comprises a polishing cloth.

25. A polishing apparatus according to claim 23, wherein said polishing surface comprises a fixed abrasive plate.

* * * * *